United States Patent [19]

Franke

[11] 4,191,141

[45] Mar. 4, 1980

[54] TWO-STROKE ENGINE WITH AUXILIARY FLUID MEANS

[76] Inventor: Walter Franke, Hittfelder Kirchweg 22, 2105 Seevetal 3, Fed. Rep. of Germany

[21] Appl. No.: 887,254

[22] Filed: Mar. 16, 1978

[30] Foreign Application Priority Data

Mar. 17, 1977 [DE] Fed. Rep. of Germany ..... 2711641

[51] Int. Cl.[2] ..... F02B 75/02; F02B 41/02; F02B 33/04

[52] U.S. Cl. ..... 123/65 A; 123/65 BA; 123/73 R; 123/73 CC; 123/25 E

[58] Field of Search ..... 123/73 R, 73 A, 73 AB, 123/73 C, 65 A, 65 BA, 25 R, 25 E, 73 CC

[56] References Cited

U.S. PATENT DOCUMENTS

| | | | |
|---|---|---|---|
| 1,043,254 | 11/1912 | Russell | 123/73 A |
| 1,143,258 | 6/1915 | Dunham | 123/73 C |
| 1,304,443 | 5/1919 | Belyavin | 123/65 A |
| 1,678,956 | 7/1928 | Schaer | 123/65 A |
| 1,967,682 | 7/1934 | Ochtman | 123/73 A |
| 2,481,901 | 7/1949 | Brache | 123/73 R |
| 3,687,118 | 8/1972 | Nomura | 123/73 A |
| 3,881,454 | 5/1975 | Jaulmes | 123/73 R |
| 3,908,613 | 9/1975 | Loby | 123/25 C |
| 4,067,302 | 1/1978 | Ehrlich | 123/73 A |
| 4,075,985 | 2/1978 | Iwai | 123/73 R |

*Primary Examiner*—Wendell E. Burns
*Attorney, Agent, or Firm*—Toren, McGeady and Stanger

[57] ABSTRACT

A single-piston or multi-piston two-stroke internal combustion engine for introducing into the working space or working spaces of the one cylinder or of the several cylinders respectively a pressurized fluid such as a gas, ambient air or a gaseous mixture or a mixture of a gaseous medium and a liquid at approximately an intermediate height of the cylinder working space between top and bottom dead center positions of the piston head surface for separating inflowing fuel-air mixture from the exiting combustion gases and for establishing a layer charge overlying the piston head. The two-stroke engine is provided with an additional inlet port for admitting this additional pressurized fluid into the cylinder working space, the inlet port being in communication with fluid supply means and optionally including an automatically pressure operated or positively actuated control member.

10 Claims, 7 Drawing Figures

48
4
3
25
24
23
35
27
49
8
10
14
29
28
13
19
18
9
2
7
12
47
11
16
45
20
46
6
1
5
6'

TWO-STROKE ENGINE WITH AUXILIARY FLUID MEANS

The present invention relates to a two-stroke engine including at least a piston reciprocating within a cylinder, piston-controlled inlet and exhaust ports for a particularly supercharged flowable fluid (fuel-air mixture or air) and exhaust gases within a zone directly above the bottom dead center position of the top of the piston, and an ignition or injection device in its upper zone for igniting the medium that is compressed within the cylinder. The invention also relates to a two-stroke engine with supercharging of the flowable fluid, an inlet, optionally a bypass, and an exhaust substantially directly adjacent a location in which the piston is in its bottom dead center position, with an ignition or injection device as well as a compressor or charging blower.

The herein employed term "flowable fluid" is intended to encompass an Otto type operation wherein a fuel-air mixture is being introduced and an ignition device is provided, and a Diesel type operation wherein optionally supercharged air is being introduced and an injection device is arranged in the cylinder head.

In two-stroke engines it is conventional to compress the mixture or air within the crankcase, and this operation is likewise included. In this case, a bypass is provided intermediate the crankcase and the cylinder or respectively the working space of the cylinder, above the piston when the latter is in the bottom dead center position. The supercharged or pre-compressed mixture or air may pass through this bypass into the working space. Likewise included are other types of supercharging means such as compressors, charging blowers or the like, as well as means for preparing the mixture. A mixture of this type may be provided by a carburettor of some type which will hereinafter be called a first carburettor.

It is conventional to design two-stroke engines in the forms of one-cylinder or multi-cylinder engines with a piston associated with every cylinder. The present invention relates to all of these types of engines.

Conventional two-stroke engines exhibit the drawback of scavenging losses. This is to say that the entering compressed mixture or air for expelling the exhaust gases likewise in expansion operation will enter partly into the exhaust port. When introducing a mixture, this leads not only to fuel losses but likewise to insufficient exhaust gas compositions having bad odors and the like. For this reason, there are presently only few vehicles equipped with two-stroke engines although engines of this type would exhibit the considerable advantage of a higher efficiency if on the one hand could be eliminated the problems of scavenging losses and on the other hand could be achieved further improvements with respect to increasing the anti-knocking property even with high speed cycles of operation wherein every downward movement of the piston, as seen from the cylinder head, is a power stroke. The loss of compressed air in Diesel type operation likewise leads to power losses or respectively requires considerable efforts for supercharging the air.

It is, therefore, the object of the present invention to provide, in the light of the above points of view, an improved method of operating a two-stroke engine as well as a novel and improved two-stroke engine wherein have been eliminated the scavenging losses, the elasticity of the engine is increased also at high speeds and there is generally obtained an improved exhaust gas combustion whereby is obtained simultaneously the possibility of a power increase with respect to heretofore known methods and two-stroke engines.

In accordance with the method aspect, this object may be achieved, in accordance with the present invention, by introducing into the cylinder space pressurized supplementary gas or particularly fresh ambient air, and this with respect to the working cycle at the end of the power stroke and at the beginning of the compression stroke wherein this gas or air separates the inflow of the flowable fluid through the inlet port from the outflow of exhaust gases and provides a layer charge on the top of the piston. This likewise substantially determines the timing of the supplementary introduction of gas or fresh air.

There will be generated a gas lock, or with the preferred introduction of air, an air lock that prevents scavenging losses and performs additional functions, i.e. when introducing a fuel-air mixture enriches this mixture as well as the exhaust gases with additional air, and this likewise with a special advantage in Diesel type methods of operation. When employing a gas, the inherent properties of this gas may be made use of.

It is especially preferred to arrange a gas or air layer charge directly above the top of the piston when the latter is in the compression stroke. A layer charge of this type provides the advantage of remaining on top of the piston likewise during the compression stroke and bringing about, during ignition of the mixture disposed thereabove and possibly enriched by a certain intermixing with the additional charge, a buffer type effect, in virtually producing a so-called shock absorption during ignition. This allows higher output powers at higher speeds.

It is preferred, however, that the supplementary gas or air feed concurrently enriches the exiting exhaust gases with oxygen. This results from the air or gas lock effect because in the turbulent zone within the working space of the cylinder the gas or air flow directed into a zone above the exhaust port is divided, and when separating particularly the fuel-air mixture from the exhaust gases, the air of gas flow is partly entrained thereby in a turbulent flow into the working space and is being partly guided toward the exhaust port, together with the exhaust gases. This enhances the afterburning.

It is possible, and this characteristic is advantageously included, that the air feed is initiated directly in dependence upon the inner pressure within the working space. Thereby it would have to be considered that the pressure within the working space is reduced upon opening the exhaust port and is not increased until the piston performs its compression stroke. Insofar simple means would be sufficient. In idling operation or when a thrust is acting on the engine, take-in may take place directly from the ambient atmosphere. It is preferred, however, that the air or the gas introduced is pressurized.

For achieving the above stated function it is suitable that the supplementary gas or air feed is effected at a spacing from the top of the piston when the piston is in its bottom dead center position.

When introducing a gaseous fluid that differs from air, this fluid may contain components which on the one hand improve the efficiency of the compressed flowable fluid, particularly of the fuel-air mixture, and on the other hand ensure an improved afterburning by enriching the exhaust gases. In a particularly preferred embodiment a liquid is introduced simultaneously with a fluid of this type, particularly air. Such a liquid serves the same purposes, in enhancing the effects. Under this point of view, the present invention provides a two-stroke engine having a so-called second carburettor the inlet of which opens into the working space of the cylinder at about an intermediate height of the piston stroke with respect to the top of the piston or respectively the uppermost gasket means at the piston top. In dependence upon the pressure of the air or gas supplied, this additional inlet port may be shifted toward the bottom dead center position. It is likewise contemplated, however, to employ the suction effect generated by the piston in idling operation or when a thrust is acting on the engine whereby a spacing of the inlet port from the bottom dead center position of the piston must be maintained.

By the inventive operation there will not only be obtained an excellent fuel economy but moreover a considerably increased exhaust gas purity that substantially enlarges the range of practical applications of a two-stroke engine by eliminating the heretofore known odorous annoyance.

A two-stroke engine of the type as stated in the introductory part of the present specification and usable in accordance with above described method of operation is characterized by a supplementary controlled inlet port for admitting at least gas or air into the cylinder in communication with this cylinder or the charging blower and is located in a plane above the exhaust port to provide in its open condition a gas or air lock that separates the entering flowable fluid, particularly a fuel-air mixture from the exhaust gases. The thereby obtained so-called air lock is provided by the supplementary inlet port in an operative condition of the engine and constitutes a separating lance for the flowable fluid, particularly a fuel-air mixture and exhaust gases but with the simultaneous effect of enriching the exhaust gases for afterburning and eliminating odorous annoyance and forming a pressure cushion on the piston top underneath the ignitable fuel-air mixture.

It is preferred that the supplementary inlet port includes a control member that is actuated in dependence upon the inner pressure within the cylinder to admit or respectively block the supplementary fluid. This allows an automatic operation in dependence upon the operating pressure. Suitably, the control member may consist of at least a check valve the valve member of which may be urged against its valve seat by the inner pressure within the cylinder space. Likewise considered may be a biasing spring.

The function of the valve ensures that the supplementary inlet port will be closed in dependence upon an explosive pressure within the cylinder, and will be open in dependence upon a pressure reduction within the cylinder below a predetermined pressure level. By providing an adjustable biasing spring, the working conditions may be adapted suitably in every case.

According to another embodiment, the control member may be controlled positively in dependence upon the crankshaft, and transmissions may be provided intermediate the control member and the crankshaft for actuating the control member toward its open position when opening the exhaust port and during an initial part of the compression stroke.

In an advantageous embodiment the supplementary inlet port includes several openings that communicate with the working space of the cylinder and are distributed about the periphery of the cylinder within a cross-sectional plane. A circular group of openings of this type improves the function by acting uniformly on the charge of the working space within the cylinder. The openings may of course communicate with a distributor conduit about the cylinder. Likewise contemplated is that these openings may be provided in the configuration of slots that correspond to the dimensions of the distributor conduit. In this context, it is possible to arrange one or several control members intermediate feed lines and the distributor conduit.

A particular characteristic resides in the fact that the inlet port or respectively the distributor conduit are arranged at approximately an intermediate height of the stroke of the piston top. In this context, it is also taken into account that the piston head may likewise be provided, directly below its top surface, with gasket means engaging the cylinder wall whereby these gasket means delimit the working space. Certain deviations upwardly or downwardly are possible within the scope of the above explained points of view.

It is likewise possible to provide this supplementary port with a directional function by a jet type or slot shaped orifice configuration with directionally orientated slot walls so that pressurized air or gas admitted will be discharged in favorable directions with respect to the above indicated function.

In this context, it should be mentioned once again that in idling operation or when a thrust is acting on the engine there may likewise be sucked in layer charge air which may likewise serve as a separating lance under the intake effect. It is preferred, however, that a compressor or a charging blower is provided in a feed conduit connected to the supplementary port for feeding air. By this, it is possible to enhance on the one hand the separation of the active fuel-air mixture from the exhaust gases, and on the other hand to enrich not only the exhaust gases but likewise to improve the formation of a layer charge that overlies the top of the piston.

In a two-stroke piston it is particularly preferred that a connection for a liquid with a suction orifice is provided at a feed line to the supplementary inlet port for gas or air. Thereby is formed a second carburettor which is arranged in an intermediate height of the cylinder or respectively the stroke of the piston top of a piston in a two-stroke engine because together with the air or respectively gas supplied by suction in idling operation or when a thrust is acting on the engine, or by compression there may be introduced into the working space a liquid that provides an improvement for the operation of a two-stroke engine toward the end that the charging of the inflowing air or gas with a liquid will render better determinable the directional jet of the inflow in the form of a lance so that fuel-air mixture and exhaust gases may be separated in a more precise manner, when being added to the fuel-air mixture in Diesel type operation when added to the air being compressed, the liquid at least partly contributes to improving the efficiency, that the liquid improves the lubrication of the engine likewise in a predetermined embodiment and that, upon entry of part of the fluid of gas and liquid into the exhaust gases, the latter may be processed so that there is either effected an automatic afterburning or respectively self-purging, or the exhaust gases are being converted into a condition so that these exhaust gases are rendered suitable for subsequent ignition after compression, for performing a power stroke. An additive in the above defined sense consists e.g. of methanol or the like, optionally likewise of hydrogen or a hydrogen fraction.

Furthermore is contemplated in an advantageous solution that as the liquid is employed a water-oil emulsion having an oil portion on the order of magnitude of 1:100 up to 1:500 with respect to water. This, however, merely constitutes a modification which on the one hand improves the lubrication of the piston and on the other hand increases the power by decomposition upon enrichment of the fuel-air mixture.

According to the preferred embodiment, the feed conduit as explained above communicating with the cylinder at about an intermediate height of the stroke of the piston top is provided with a carburettor for a fluid in combination with a compressor or a charging blower.

In the following, the present invention will be described more in detail with reference to several embodiments that are illustrated schematically in the appended drawings. The two-stroke engine may include several piston-cylinder assemblies in an in-line, V type, opposed-piston type or a star type arrangement. All of these arrangements are contemplated to be fully within the scope of the present invention. In the illustrated examples is shown merely one cylinder with a piston above a crankcase with a crank for illustrating purposes.

In the various Figures of the drawings similar parts are indicated by the same reference numerals.

The drawings not only depict various phases of the cycle of operation of an engine but likewise modifications of the engine. In these drawings.

Figure 1:
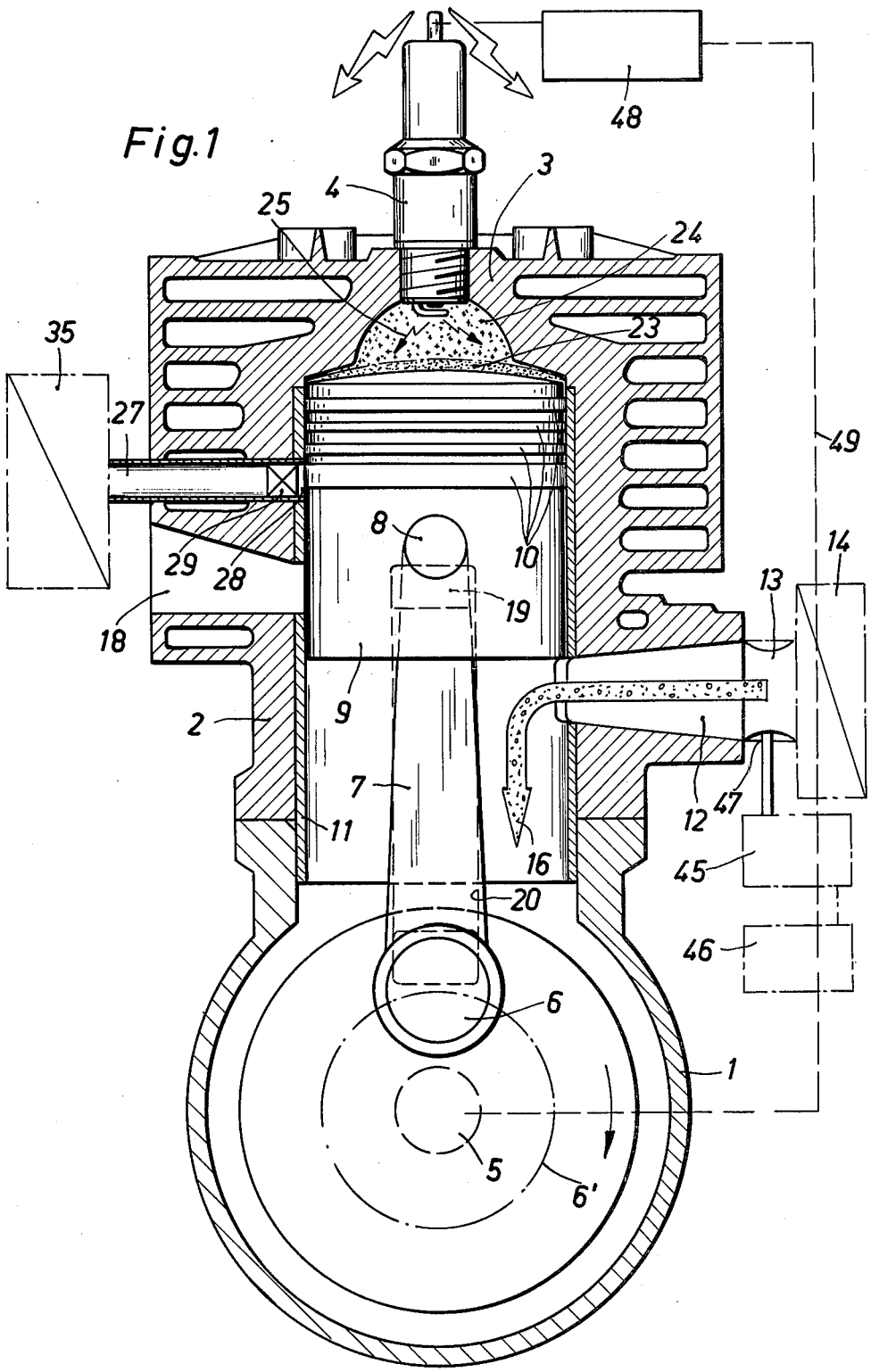
FIG. 1 is a schematical cross-sectional elevational view of an engine upon ignition at the beginning of a power stroke.

According to the drawings, the engine may be designed in a multiple-piston arrangement as described above. The engine includes a crankcase 1, a cylinder 2 with a cylinder head 3 in which is mounted an ignition device 4. The ignition device 4 is actuated in the conventional manner through a distributor not shown, in dependence upon the rotational position of a crankshaft 5. The crankshaft includes a crank with a crank pin 6. The crank pin which is arranged at a disc member of the crankshaft in the conventional manner rotates along the circle 6'. At this crank pin is mounted a connecting rod 7 by suitable bearing means. The connecting rod 7 engages at its other end the gudgeon pin 8 of the piston 9 which is reciprocable within the cylinder 2. The piston includes piston rings 10 for ensuring a fluid-tight guiding of the piston optionally within a cylinder sleeve 11.

The ignition device 4 is connected in the conventional manner to a distributor 48 including all of the associated devices. This distributor communicates with the crankshaft 5 through a transmission 49.

In the here illustrated embodiment the crankcase 1 constitutes the supercharging device for the mixture. At the cylinder 2 is provided a feed port 12 toward this purpose. This feed port 12 communicates e.g. through a conduit 13 with a device 14 which includes a carburettor as well as a fuel reservoir. In this carburettor are mixed air and fuel, as indicated in FIG. 1 in which in the illustrated flow-indicating arrow 16 the air is shown as dots and the fuel is shown as small circles. The fuel-air mixture is sucked into the crankcase 1 when the piston 9 approaches the upper region within the so-called working space in the cylinder 2.

An outlet or exhaust port 18 and an inlet port 19 open into the cylinder or respectively the so-called working space 17 of the cylinder in a position above the piston 9—in dependence upon the piston position. The inlet port 19 is at the end of a bypass 20 the inlet port of which is indicated by the reference numeral 21. This inlet port opens into the crankcase 1 so that in the operation with crankcase scavenging, mixture compressed within the crankcase may bypass into the working space 17 when the piston 9 is in its bottom dead center position. In this condition, the exhaust port 18 is likewise open.

Likewise contemplated is a so-called blower scavenging. With this type of operation, the crankcase is not employed as a charging space but is merely filled with oil. With respect to the illustration, the device 14 which includes a charging blower would not be in communication with the feed port 12 by its conduit 13 and the associated parts, and this feed port 12 would be sealed. The device 14 would be provided at the inlet port 19. The bypass 20 would be omitted.

As explained with respect to FIG. 1, a mixture of fuel and air enters through the feed port 12. As shown by the flow part 22 in FIG. 2, this compressed mixture enters into the working space 17, and it should be noted that in comparison to FIG. 1 the power stroke has been performed in the meantime.

According to FIG. 1 in which the piston 9 is shown in the top dead center position, there is a layer 23 of a gas, particularly air, that has been supplied in a separate manner as described further below, at the top of the piston, and on top of this layer within the space 24 the compressed mixture of ignited fuel and air so that a working stroke will be performed upon ignition according to the arrows 25. This ignited mixture which has developed power will be driven toward the exhaust port 18 according to the arrow 26 in FIG. 2 whereby turbulent flow of the flow path 22 does not readily ensure the separation between fresh fuel-air mixture and exhaust gases.

The present invention, however, provides a supplementary inlet port 27 the port orifice 28 of which at the working space 17 is at an intermediate height of the stroke of the piston 9 but in any case above and advantageously in a higher position than the exhaust port 18 and the inlet port 19. When with respect to FIG. 2 the piston 9 has moved downwardly so far so as to clear the exhaust port 18, the pressure within the working space 17 is relieved. In dependence upon either this operational condition a compressor or a charging blower 35 at the inlet 27 is activated or respectively a control member 29 at the port orifice 29 of the inlet port 27 is opened so that according to FIG. 3 a gas flow enters into the working space 17. This gas flow 30 has the effect of a separating lance, due to its position and direction according to the arrow 31. This gas flow separates the flow path 28 of the fuel-air mixture from the exhaust flow 32 whereby part of the inflowing fluid escapes together with the exhaust gases through the exhaust port 18 or respectively the exhaust conduit in accordance with the arrow 33, in enriching these exhaust gases and improving these gases for further usage or for air or respectively exhaust gas purification.

Figure 3:
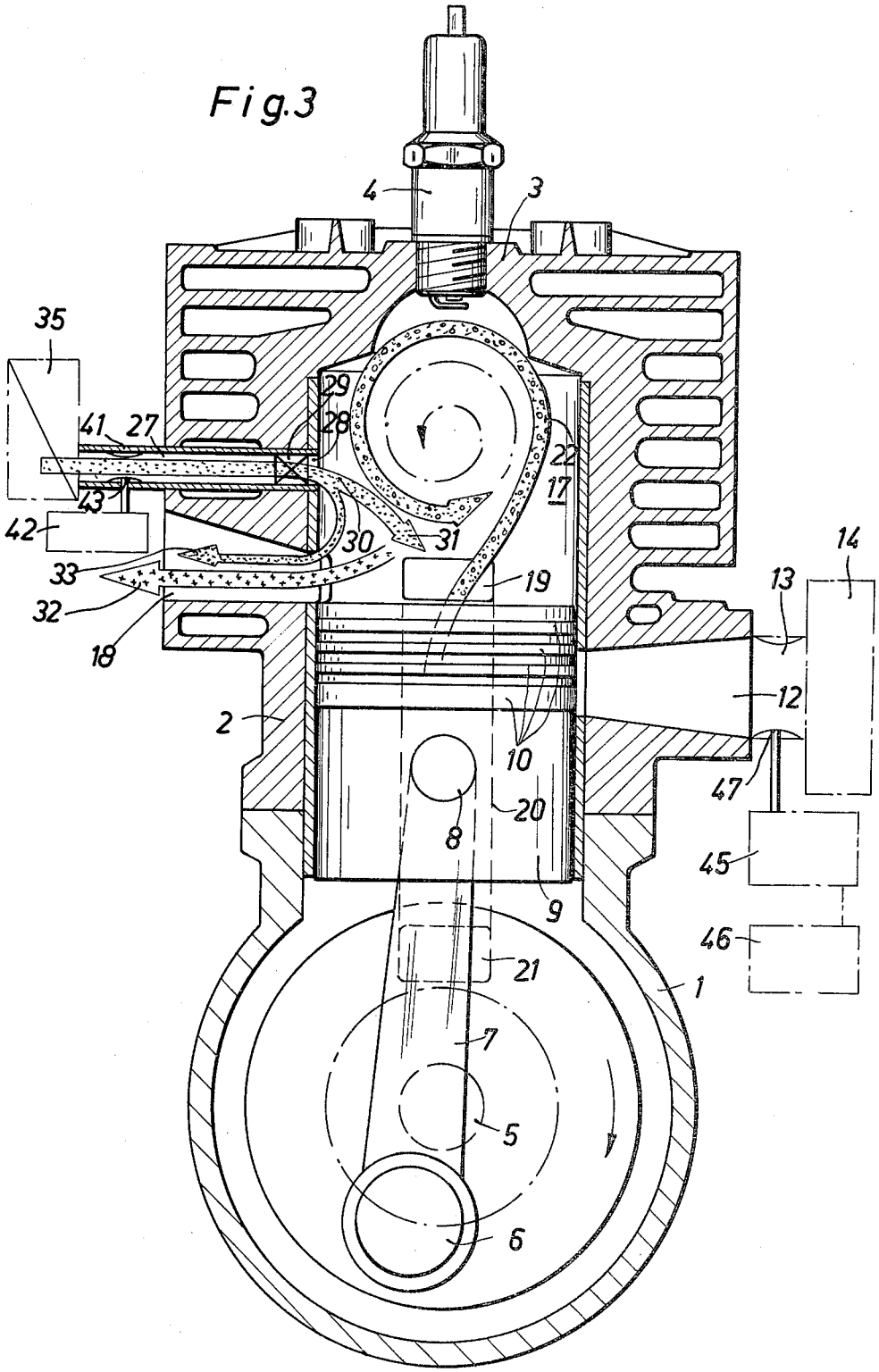
FIG. 3 is a view of the same engine when the crankshaft has been rotated incrementally further whereby a liquid source is arranged at the feed conduit of the supplementary inlet port.
Figure 4:
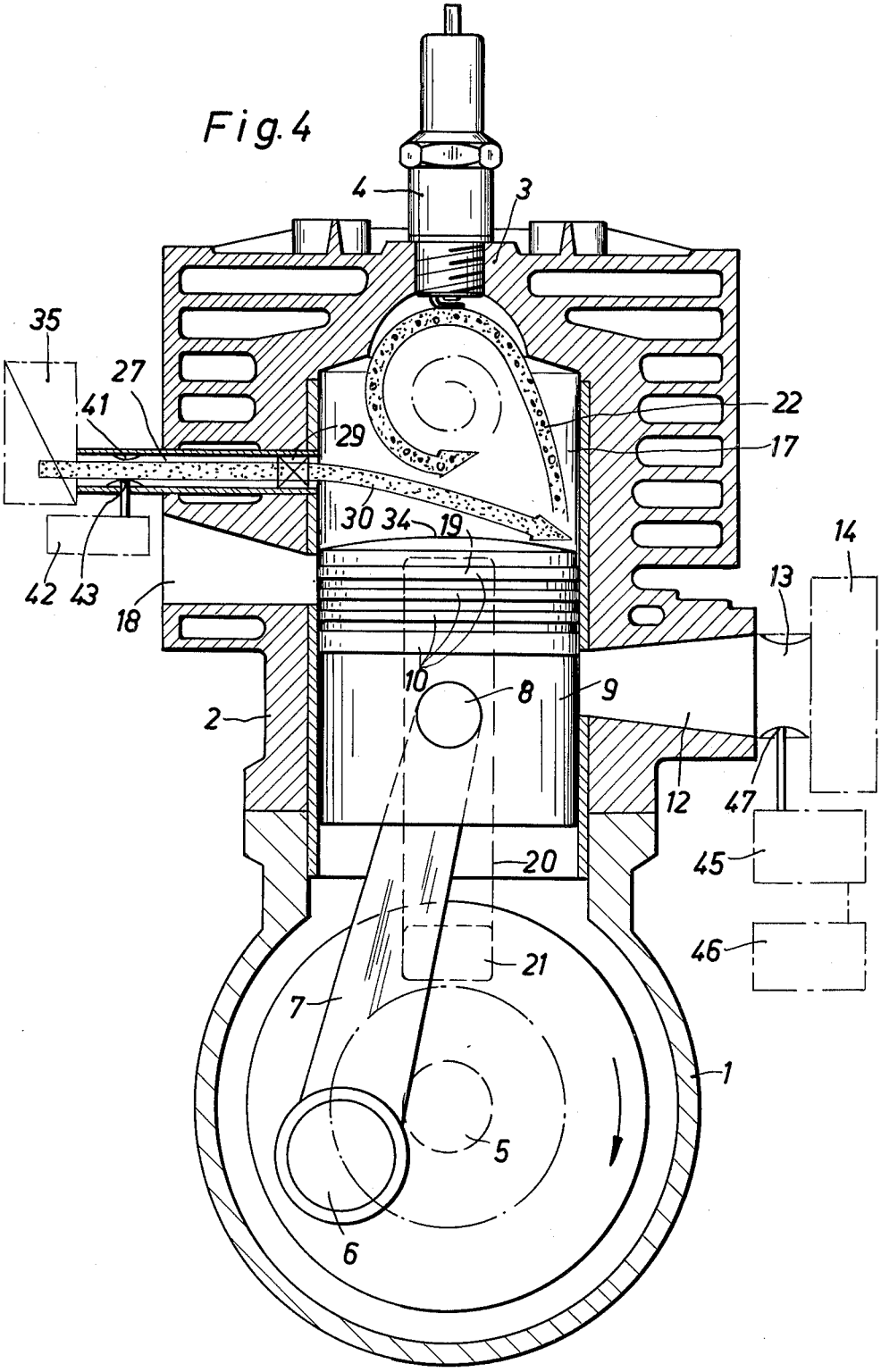
FIG. 4 is a view of the engine condition at about the compression stroke before the condition of FIG. 1 is reached, the engine shown having likewise an additional liquid source.

Referring to FIG. 4, there is shown a working condition that will be reached after a still further small incremental rotation of the crankshaft with respect to the position shown in FIG. 3. In this working condition, the top 34 of the piston has already blocked the exhaust port 18. The compression of the introduced fuel-air mixture corresponding to the flow path 22 takes place whereby the gas flow 30 through the inlet port 27, however, does not only penetrate underneath the turbulent flow but concurrently generates above the piston top 34 a gas or respectively air layer charge shown in FIG. 1 at 23 and having the effect of a shock absorber. Apart from this action, the mixture will be enriched in the contact zone between the gas flow 30 and the turbulent flow within the working space 17.

In operation with a scavenging pump the top of the piston may be employed for compressing the air or the gas introduced through the supplementary inlet port 27.

In this last described embodiment, it would likewise be possible, when providing a connecting rod at the piston, to block the zone underneath the piston by an intermediate wall through which extends the connecting rod, and to employ the space formed thereby for supercharging the air or the gas introduced through the supplementary inlet port 27.

In FIGS. 3 and 4 is shown a particular modification wherein a liquid source 42 communicating with a suction port 43 in the feed conduit 41 is provided at the feed conduit 41 for the supplementary inlet port 27. Thereby is formed at the supplementary inlet a second carburettor for the fluid of the reservoir 42. Additional control elements as conventional in carburettors may be employed. The assembly 42 may be arranged in a corresponding manner.

With respect to FIGS. 1 to 4 it has been described above that the device 14 on the whole includes a carburettor and a fuel reservoir. For a more detailed explanation 14 may be shown as an air filter or compressor, and into the conduit 13 opens a suction port 47 at a line communicating with a carburettor 45. This suction port 47 may be arranged particularly adjacent a nozzle type restriction. The carburettor 45 in turn communicates with a fuel reservoir 46.

Figure 5:
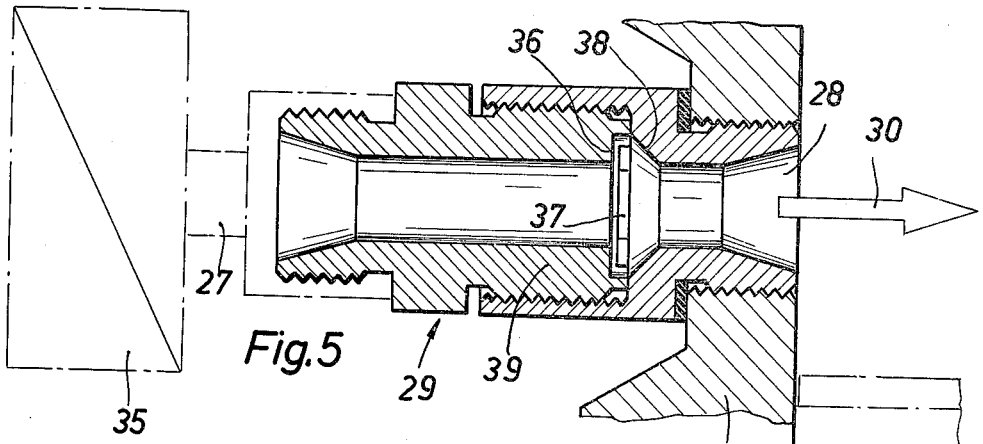
FIG. 5 is a fragmentary sectional view for explaining an embodiment of a control member.

FIG. 5 illustrates a separate control member 29. A valve housing 39 is threadedly mounted in the cylinder wall at the supplementary inlet port 27. This valve housing includes a valve seat 36, and a disc-type valve member 37 overlies this valve seat 36. The valve member 37 will be retained at the orifice 28 to the working space 17 of the cylinder in front of the valve seat by recessed wall portions 38.

Figure 6:
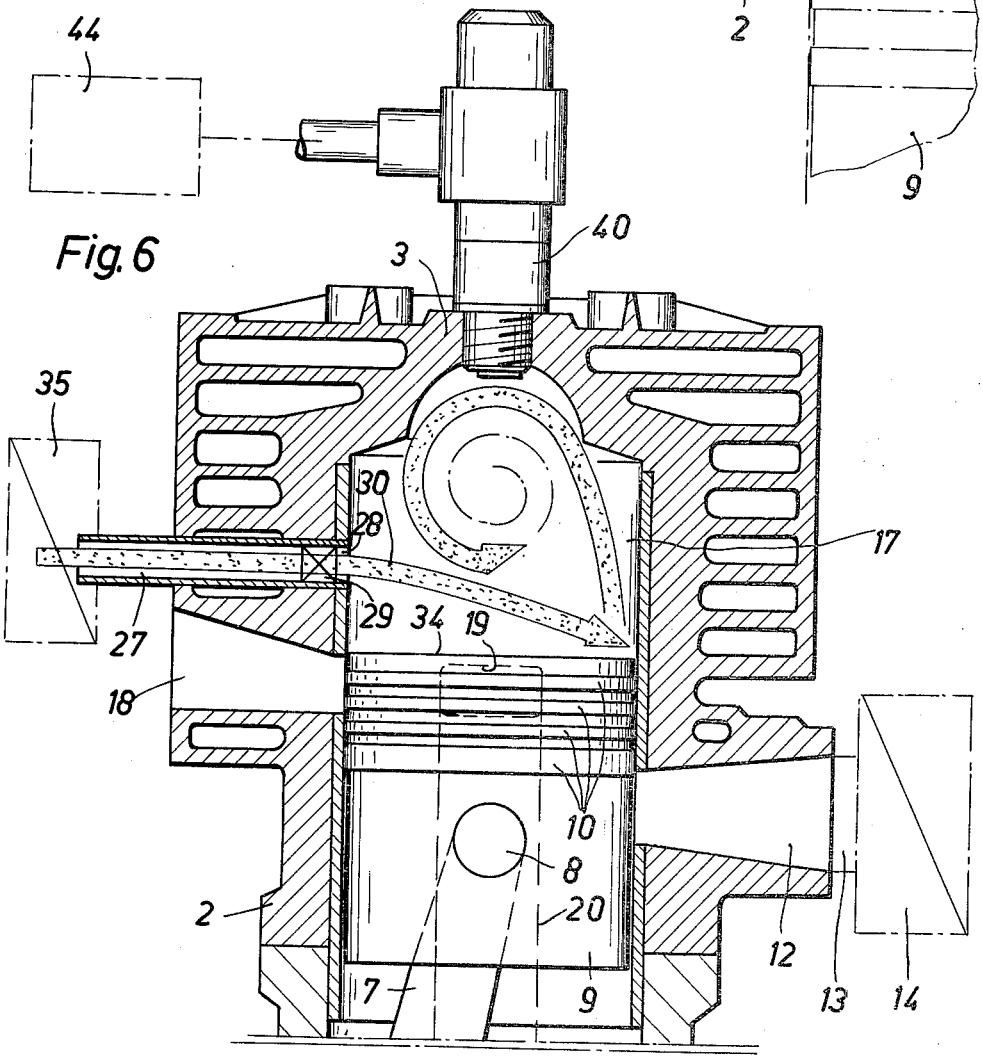
FIG. 6 is a view similar to FIGS. 1 to 4 for illustrating a Diesel type engine operation in the operative position of FIG. 4.

FIG. 6 shows another arrangement which substantially corresponds to FIG. 4, for explaining a Diesel type operation. The ignition device 4 is replaced by an injection device 40 that communicates with a source 44 of fuel, and this device may include a conventional injection pump with associated control members. The injection is controlled via a transmission by the crankshaft, in a manner similar to the transmission 49 of FIG. 1.

Figure 2:
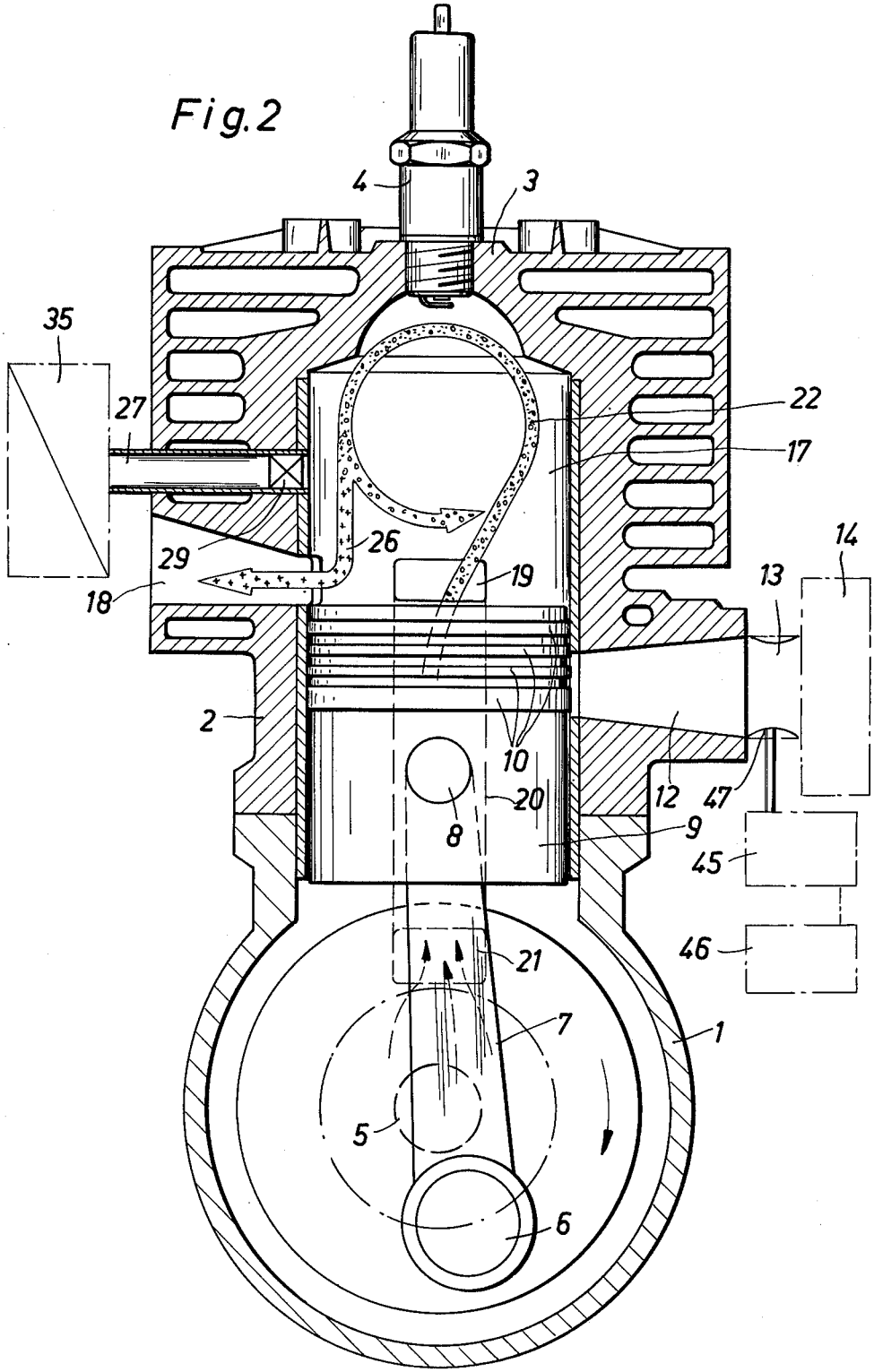
FIG. 2 illustrates the same engine toward the end of the power stroke when the piston is in a position shortly before its bottom dead center position.

In Diesel operation a liquid may be introduced through the supplementary inlet port 27 whereby the parts 27 of the illustrations of FIGS. 1 to 3 would then be provided as shown in FIG. 6 with the elements 41, 42, 43. The same similarly applies to the arrangement of the conduit 13 with respect to the illustrations of FIGS. 1 to 4 so that, likewise, a liquid may be added to the introduced air and the part 14 includes a blower. This constitutes an advantageous embodiment.

The same method may likewise be employed in two-stroke engines with U-shaped cylinders and oppositely running pistons whereby the secondary air into the exhaust cylinder must be directed toward the piston moving therein.

Figure 7:
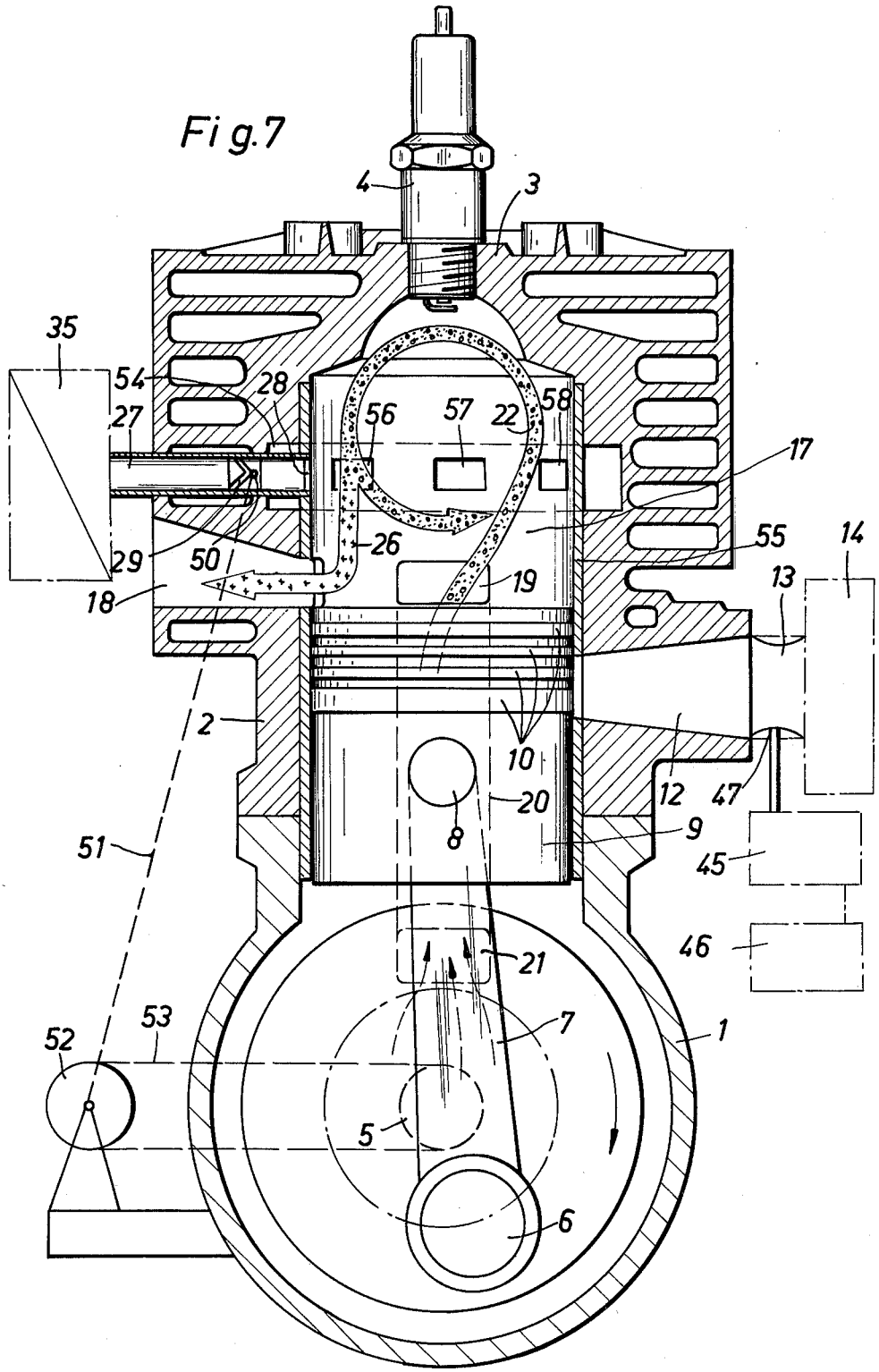
FIG. 7 is a view similar to FIG. 2 for illustrating a further modification.

In FIG. 7 the control member 29 is different from the one according to FIG. 5. This control member may e.g. consist of a control valve with a movable valve member for opening or blocking the passage by adjustment. Toward this end, an actuating lever 50 is provided at the control member 29. The actuating lever 50 is operatively connected to an actuator 52 through a functional connection 51. This actuator 52 is operatively connected to the crankshaft 5 through a transmission 53. This arrangement allows cyclical opening and closing. FIG. 7 illustrates a further embodiment insofar as the cylinder working space is surrounded by a peripheral distributor conduit 54. This distributor conduit is generally closed toward the working space 17 by the cylinder wall 55. This cylinder wall, however, is not only provided with the one port in the form of the orifice 28 but the distributor conduit includes further openings 56, 57, 58 spaced about the circumference of the cylinder in a cross-sectional plane.

What is claimed is:

1. A two-stroke internal combustion engine comprising: cylinder means including inner wall means defining interior portions of said cylinder means; piston means operably reciprocal within said cylinder means between an upper and a lower dead center position; inlet port means for introducing a supercharged fuel-air mixture into said cylinder means; ignition means for igniting said fuel-air mixture within said cylinder means; exhaust port means in flow communication with the interior of said cylinder means at a location immediately above said piston means with said piston means in said bottom dead center position for exhausting combustion gases from within said cylinder means; and auxiliary port means including auxiliary fluid source means for introducing an auxiliary fluid into said cylinder means; said auxiliary port means extending through said inner wall means in flow communication with said cylinder means interior portions at a location directly above and generally angularly aligned with said exhaust port means, said inlet port means being located to extend through said inner wall means in flow communication with said cylinder means interior portion at a location angularly displaced by about 90° from said exhaust port means and said auxiliary port means.

2. An engine according to claim 1 wherein said auxiliary port means include control means actuated in response to internal pressure within said cylinder means and operating to control feeding of auxiliary fluid from said auxiliary fluid source means through said auxiliary port means.

3. An engine according to claim 2 wherein said control means comprise check valve means including valve body means adapted to be urged against valve seat means by inner pressure within said cylinder means.

4. An engine according to claim 2 including crank shaft means operatively driven by said piston means and further comprising transmission means operatively interposed between said control means and said crank shaft means for effecting positive control of said control means to open said auxiliary port means during an initial portion of a combustion stroke of said piston means and while unblocking said exhaust port means.

5. An engine according to claim 1 further including additional inlet port means comprising orifice means disposed above said exhaust port means.

6. An engine according to claim 1 further including distributor conduit means circumscribing said cylinder means at a level generally equivalent to the level of said auxiliary port means and including a plurality of openings opening into said cylinder means interior portions to provide additional inlets from said distributor conduit means in cross-sectional planes thereof.

7. An engine according to claim 1 wherein said auxiliary port means includes a plurality of orifices located in said inner wall means of said cylinder means, with at least one of said orifices being arranged at about an intermediate height of the stroke of the top of said piston means.

8. An engine according to claim 1 further including feed conduit means in flow communication with said auxiliary port means, connection means in communication with said feed conduit means, fluid source means in communication with said connection means, said connection means including suction port means opening into said feed conduit means for forming a carburetor for a liquid, and air compressor means.

9. An engine according to claim 1 wherein said auxiliary fluid introduced by said auxiliary fluid source means comprises air.

10. An engine according to claim 1 wherein said auxiliary fluid introduced by said auxiliary fluid source means comprises a liquid in the form of a water-oil emulsion having an oil portion on the order of magnitude of 1:100 up to 1:500 with respect to water.

* * * * *